United States Patent [19]

Jenkins et al.

[11] 3,969,137

[45] July 13, 1976

[54] CONDUIT FOR TRANSMITTING WASHING LIQUID TO AN UPPER SPRAY ARM IN A DISHWASHER

[75] Inventors: Thomas E. Jenkins; Donald S. Cushing, both of Louisville, Ky.

[73] Assignee: General Electric Company, Louisville, Ky.

[22] Filed: June 25, 1975

[21] Appl. No.: 599,393

[52] U.S. Cl. ..... 134/176; 134/183; 239/245

[51] Int. Cl.[2] ..... B08B 3/02

[58] Field of Search ..... 134/174, 176, 179, 182, 134/183; 239/245, 261

[56] References Cited

UNITED STATES PATENTS

| | | | |
|---|---|---|---|
| 2,178,198 | 10/1939 | Binz | 134/182 X |
| 2,954,038 | 9/1960 | Girard | 134/179 X |
| 3,017,892 | 1/1962 | Mixon | 134/176 |
| 3,064,665 | 11/1962 | Martiniak | 134/176 |
| 3,253,784 | 5/1966 | Long et al. | 134/176 UX |
| 3,385,523 | 5/1968 | Stouder | 134/183 UX |
| 3,444,870 | 5/1969 | Lyman | 134/179 |
| 3,774,626 | 11/1978 | Schweitzer | 134/183 X |

FOREIGN PATENTS OR APPLICATIONS

| | | | |
|---|---|---|---|
| 1,428,499 | 1/1969 | Germany | |
| 1,628,601 | 8/1970 | Germany | 134/176 |

*Primary Examiner*—Robert L. Bleutge
*Attorney, Agent, or Firm*—Robert W. Fletcher; Francis H. Boos

[57] ABSTRACT

A telescoping conduit for transmitting washing liquid from a lower spray arm assembly to an upper spray arm in the wash chamber of a dishwasher. The conduit includes telescoping stabilizing means to insure that the conduit engages a connection member positioned on the upper spray arm.

2 Claims, 3 Drawing Figures

CONDUIT FOR TRANSMITTING WASHING LIQUID TO AN UPPER SPRAY ARM IN A DISHWASHER

BACKGROUND OF THE INVENTION

Dishwashing machines of the type used in households and small restaurants usually comprise a tub having upper and lower racks within which are arranged articles to be washed. Ordinarily, the lower rack is loaded with the larger-size plates, bowls, pots and pans, and the like, and the upper rack is particularly designed to carry the smaller dishes, cups and glassware. It is desirable to have two arrangements of rotating spray arm devices, one disposed below the lower rack and a second located between the upper and lower racks.

Customarily, both the upper and lower spray arm devices have orifices or jets which spray the washing and rinsing liquid upwardly against the dishes in the rack thereabove. In addition, a number of these orifices or jets may be positioned so that the water streams issuing therefrom cause the spray arm itself to rotate, thereby achieving maximum coverage of the dishes by the washing liquid.

Heretofore, an upper spray arm had been provided, as described in U.S. Pat. No. 3,064,665, supported by a permanent tower structure, with the spray arm located at the uppermost terminal thereof.

In another version, an upper rotating spray arm was attached to the underside of the upper rack and fed by a stream of liquid passing upwardly through a suitable opening in the lower rack and received by an energy converter, as described in U.S. Pat. No. 3,444,870.

It has been noted, however, that both of the above attempts at providing a rotatable upper spray arm have had certain problems associated therewith. For instance, in the arrangement of U.S. Pat. No. 3,064,665, provision had to be made for the lower rack to be withdrawn and repositioned inside the washing chamber without disturbing the tower. This was accomplished by providing a split rack which allowed the legs of the rack to straddle the tower. This arrangement, unfortunately, reduces the effective size of the lower rack and therefore reduces the effective washing capacity of the dishwasher.

In the embodiment of the 3,444,870 patent, the disadvantage resides in the fact that the water stream passes openly through the wash chamber and is therefore susceptible of being blocked by any article which may be accidentally placed or moved into its path. Furthermore, the jet stream loses much of its force and effectiveness by being passed into an energy converter for distribution throughout the upper rotating spray arm. In addition, the advantages of transmitting the washing fluid within a conduit under pressure are lost using the open-stream approach.

The present invention overcomes these prior art problems and provides a simple, straightforward, readily-constructed and easily-maintained system for transmitting washing fluid from a rotating lower spray arm to a rotating upper spray arm in a dishwasher.

SUMMARY OF THE INVENTION

The invention provides a telescoping conduit in flow relationship with a lower rotating spray arm and pump assembly, which, when pumping of washing liquid in the diswasher begins, telescopes upwardly, directed by a stabilizing means within the conduit to meet with a coupler connection on a second spray arm rotatably attached to an upper article receiving rack in the dishwasher. The conduit arrangement rotates with the lower spray arm and transmits water to the upper spray arm, thereby enabling the upper spray arm to rotate and distribute washing liquid therefrom. During the operation of the wash and rinse cycles of the dishwasher, after an initial startup period, the upper spray arm, the conduit, and the lower spray arm will all rotate at the same speed.

More specifically, the invention includes a dishwashing apparatus comprising a tub, upper and lower racks within said tub to receive articles to be washed, said racks being in vertical spaced relation; a first spray arm device disposed for rotational movement within said tub below said lower rack and a second spray arm device rotatably attached to said upper rack and disposed intermediate said upper and lower racks, each of said spray arm devices having orifices to discharge liquid against articles in said racks, said orifices of said first and second spray arm additionally being directed to induce said devices into rotation in response to water flowing therethrough; means for mounting said first and second spray arm devices for rotation relative to said racks; a telescoping conduit attached in flow communication and rotatable with said first spray arm device, extensible upwardly to said second spray arm device; means for supplying washing water to said first spray arm device through said telescopic conduit to said second spray arm device; and means attached to said second spray arm device for mechanically receiving said telescopic conduit for transmission of liquid to said second spray arm device while rotating; and, telescopically extensible stabilizing means within said telescopic conduit to stabilize said conduit during transmission of washing water therethrough.

DESCRIPTION OF THE PREFERRED EMBODIMENT

Figure 1:
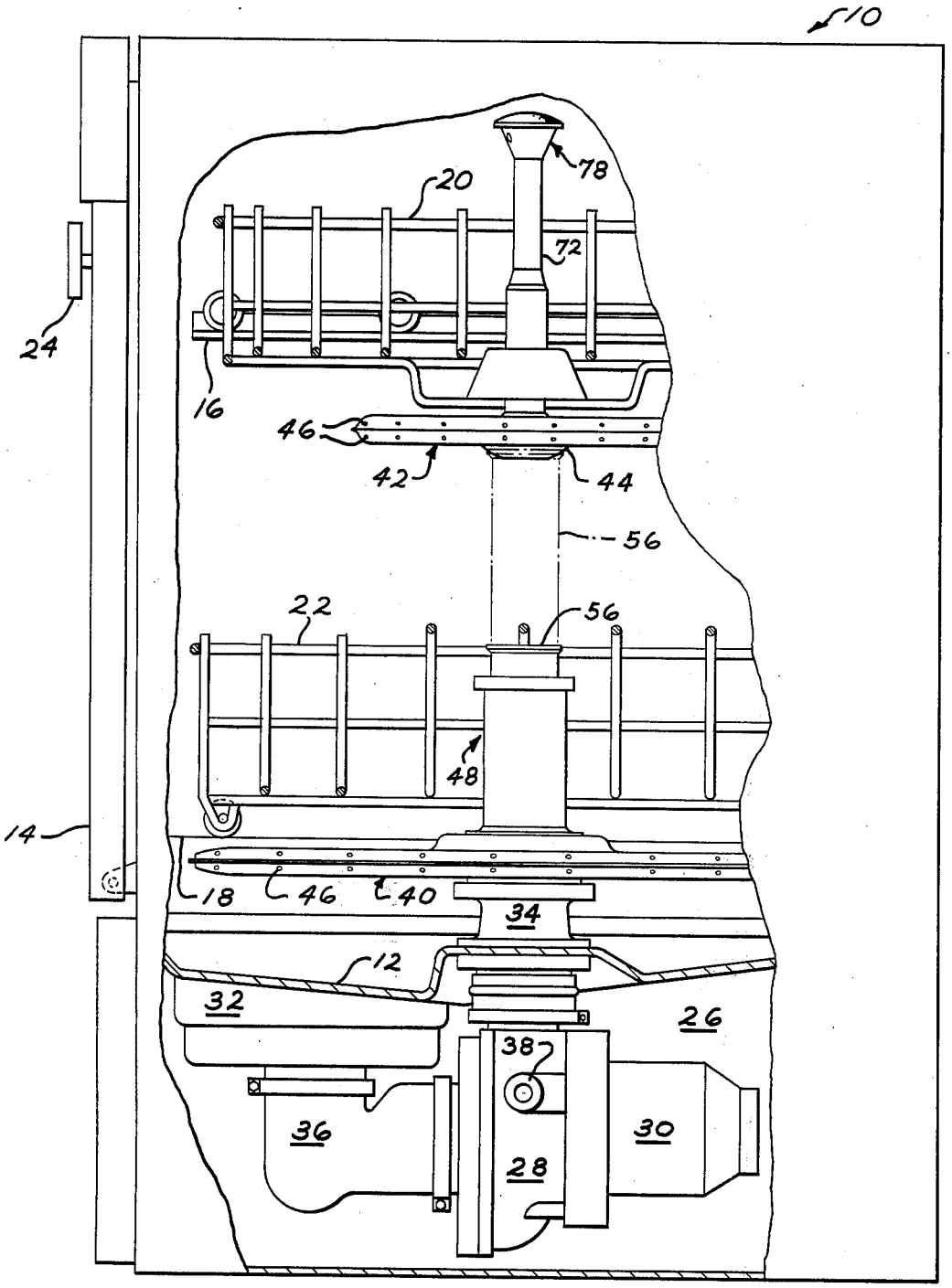
FIG. 1 is a side elevational view, partially cut away, of a dishwasher including a telescoping conduit for transmission of water from the pump and lower spray arm assembly to an upper spray arm.

Referring to FIG. 1, the invention is disclosed in an otherwise conventional domestic dishwasher in which an outer cabinet 10 includes a diswasher tub 12 therewithin. The tub includes a front opening and a door 14 hinged at its bottom to be movable between a normally closed vertical position and a horizontal open position.

Suitably mounted on opposite sidewalls of the tub are upper and lower guide rails 16 and 18, respectively. These guide rails accommodate the upper and lower roller-equipped racks 20 and 22, respectively. As is well known in the art, the respective racks are constructed to be movable between a loading position, partially outside the outer cabinet 10, and a washing position completely within the outer cabinet. It is also customary to provide a silverware basket (not shown) usually removably positioned at a suitable location within the lower rack.

A conventional time cycle control 24 is mounted at a convenient location in the upper portion of the door 14 and by conventional and well-known circuitry is arranged to control the operating mechanism disposed in a machinery compartment 26 below the tub 12. Also, the operating components include a pump 28 arranged to be driven by an electric motor 30, thereby providing for the circulation of water from the sump portion 32 of the tub to a main water discharge pipe 34.

This recirculation system includes the inlet pipe 36 which connects sump 32 to the inlet of pump 28. Pump 28 further includes a discharge conduit 38 which communicates in flow relationship with the sewer lines of the building plumbing system.

The present invention is primarily concerned with means for obtaining the optimum circulation of the washing and rinsing liquid within the tub. Accordingly, the liquid distribution system comprises a lower spray arm device 40 rotatably mounted within the lower portion of the tub 12 so as to rotate in relatively close proximity to the bottom of the lower rack 22. Similarly, an upper spray arm device 42 is rotatably attached to the upper rack 20 in close proximity thereto and at a sufficient height above the lower rack to be above the largest dish or platter which may be placed on the lower rack. The upper spray arm device includes a downwardly convex hub 44 whose function will be described hereinafter.

Both the upper and lower spray arms include an arrangement of discharge ports or orifices for directing washing liquid upwardly onto the dishes located in the rack immediately thereabove. In addition, one or more of the orifices 46 may be positioned to provide a rotational force by virtue of washing liquid being emitted therefrom, to induce the respective spray arm to rotate for optimum coverage of the dishes by the washing spray. Also, the upper spray arm may include discharge orifices which direct washing liquid downwardly onto the dishes in the lower rack.

Figure 2:
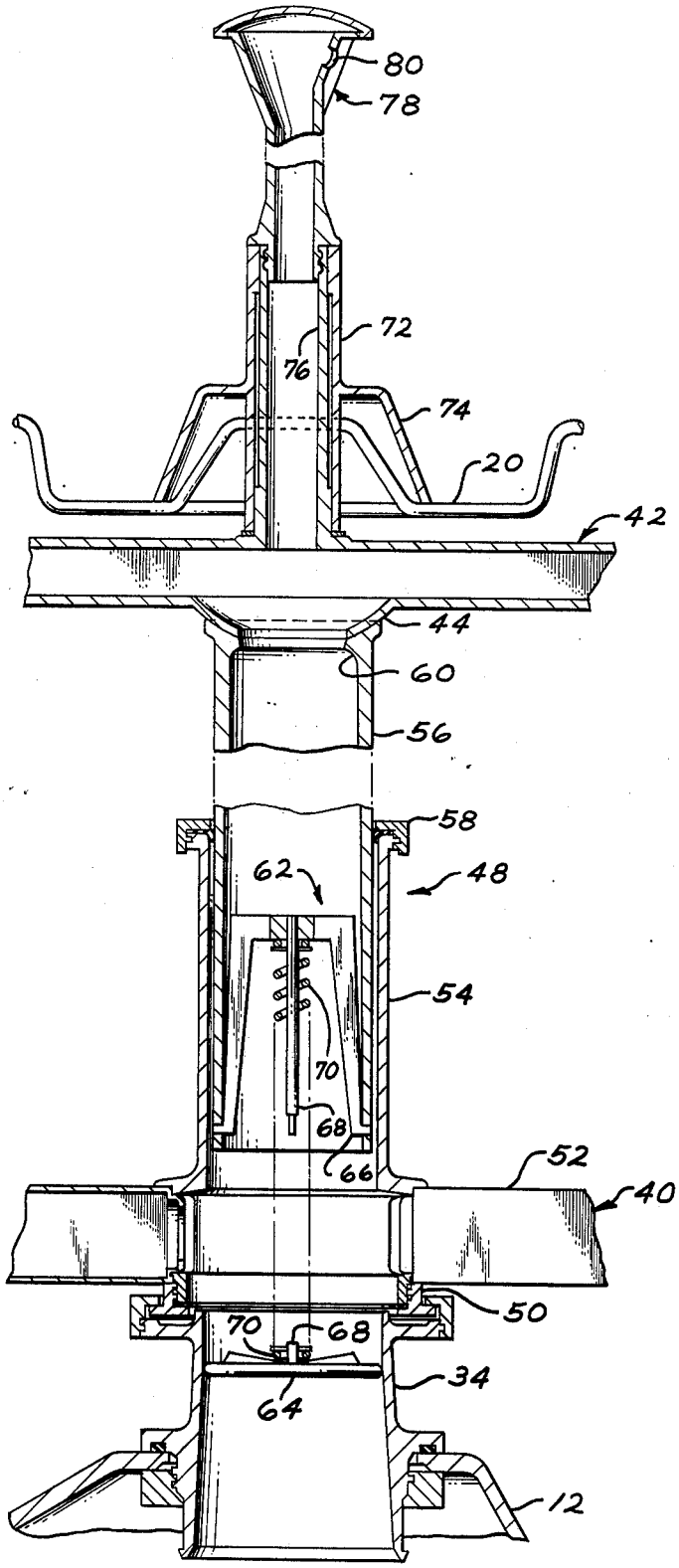
FIG. 2 is a partial cross-sectional, elevational view of the conduit of FIG. 1 extended in flow communication with the upper spray arm.

FIG. 2 shows in fragmentary section the upper and lower spray arms 40 and 42, and, a telescoping conduit 48 for achieving flow communication therebetween. FIG. 2 also shows means for spray arms 40 and 42 to be rotatably positioned within the dishwasher washing chamber. In this regard, lower spray arm 40 extends radially from a tubular bearing portion 50, which cooperates with water discharge pipe 34, to permit rotation thereof. The provision for rotation of upper spray arm 42 will be discussed hereinafter.

Telescoping conduit 48 is attached to the upper face 52 of the lower spray arm in flow communication therewith and with the water discharge pipe 34. Telescoping conduit 48 is comprised of a lower tube 54 and an upper smaller-diameter tube 56 sized to be received within tube 54 and a sealing joint 58. Upper tube 56 of the telescoping conduit 48 is tapered slightly to neck down from its base portion to its uppermost portion. In addition, it preferably has a constriction 60 adjacent its upper end. The taper of upper tube 56 and the constriction cooperate to provide a slight resistance to fluid flow therethrough. Thus, when washing liquid is discharged through the water discharge pipe 34 from the pump outlet, that portion entering conduit 48 will cause upper tube 56 to rise and engage convex hub 44. Note, in this regard, that the upper end of upper tube 56 is configured to conform with convex hub 44 for the maximum sealing effect, as well as for centering of the hub and upper tube. It has been found that it is critical that hub 44 be convex downwardly and be engaged by a concave upper portion of the telescoping conduit 48 for maximum effectiveness in centering the upper spray arm for most effective washing. This feature is particularly important where the upper rack of the dishwasher is provided with a rack level adjustment mechanism which would allow the rack to tilt in a plane at a slight angle to the horizontal.

Telescoping conduit 48 further includes telescoping stablilizing means located therewithin. Thus, as shown in FIG. 2, when the conduit 48 is fully extended, the stabilizing means is similarly extended to give support and direction to the upper tube 56 as it is moved upwardly to engage hub 44.

Figure 3:
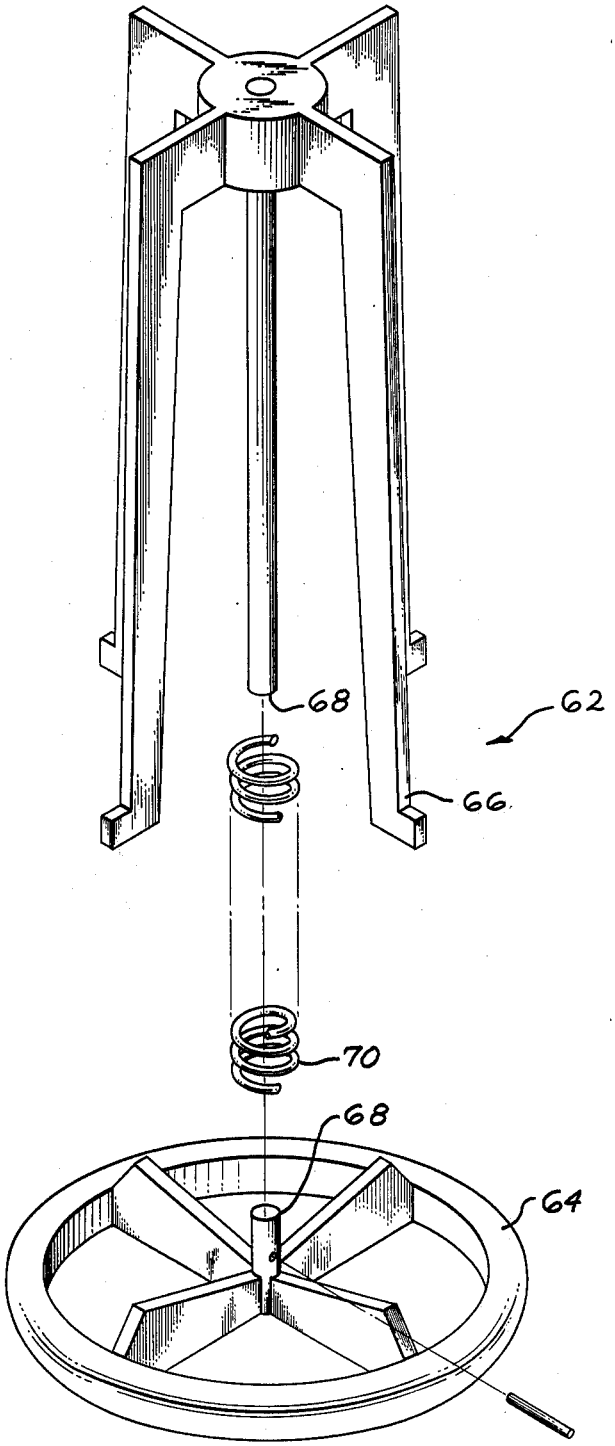
FIG. 3 is an exploded view of the stabilizing means shown within the conduit in FIG. 2.

Stablilizing means 62, shown in detail in FIG. 3, includes a base 64, double arches 66, telescoping rod assembly 68, and spring 70. Stabilizing means 62 is inserted into conduit 48 with the base member internally attached to the lower tube or, as shown in FIG. 2, internally attached in the water discharge pipe 34. The double arches 66 are then attached to upper tube 56 in any suitable fashion. Thus, when the water flowing through upper tube 56 causes it to move upwardly, spring 70 is stretched and the telescoping rod assembly 68 lengthens to give stability to upper tube 56 and direct it more accurately on a straight line toward convex hub 44. Spring 70 is, of course, of preselected biasing strength so that it can be extended by the force of washing liquid flowing through upper tube 56 and yet return the conduit to its unextended position when the liquid flow is stopped.

As explained earlier, upper spray arm 42 is attached to the underside of upper rack 20 and is permitted to rotate by virtue of bearing tube 72 which may be integrally attached by suitable support members 74 to upper rack 20. Upper spray arm 42 includes an axial conduit 76 which cooperates with bearing tube 72 to provide the rotational support for it. Further, axial conduit 76 has attached at its upper end spray tower 78. Spray tower 78 has a discharge orifice 80 for the directing of washing liquid downwardly onto the dishes located on the upper rack.

In the operation of the dishwasher of this invention, the racks are first moved to their loading position partially outside the cabinet and loaded with soiled dishes. The racks are then moved to their wash position completely within the cabinet. The door is closed and the timer is set to initiate a washing cycle. Water is introduced into the dishwasher tub and, upon reaching a preselected level, the motor is actuated and circulation of the water begins. The water is collected in the sump and drawn into the pump and then discharged through the water discharge pipe 34. The water is distributed into the lower spray arm 40 and out through the orifices 46 therein. The discharge of the water through the orifices causes spray arm 40 to begin to rotate.

An additional portion of the water is forced into the telescoping conduit 48 and, as it begins to pass upwardly through upper tube 56, it causes the upper tube to rise and engage convex hub 44. Water then begins to flow into upper spray arm 42 and be discharged through its orifices 46. At this time, it should be noted that conduit 48 is rotating in conjunction with lower spray arm 40 at a speed of rotation greater than upper spray arm 42. However, as water continues to be passed into upper spray arm 42, the rotational speed thereof increases until the rotational speeds of the upper and lower spray arm are the same.

As upper tube 56 is being forced into engagement with convex hub 44, stabilizing means 62 insures that the line of travel will be vertically upwardly to permit specific engagement. The stabilizing means accomplishes this function by having a set of double arches 66 fastened inside upper tube 56 and a base portion 64 attached inside either the water discharge pipe or lower tube 54. The double arches and base of the stabilizing means of course are separable elements connected only by a telescoping rod assembly and biasing spring. Thus, the telescoping rod assembly may easily be telescoped outwardly by overcoming the bias of the spring to provide for the conduit to be stabilized as it is telescoped upwardly to join in fluid-flow communication with the upper spray arm.

Having thus described the invention, what is claimed is:

1. A dishwashing apparatus comprising a tub; upper and lower racks within said tub to receive articles to be washed, said racks being in vertical spaced relation; a first spray arm device disposed for rotational movement within said tub below said lower rack and a second spray arm device rotatably attached to said upper rack and disposed intermediate said upper and lower racks, each of said spray arm devices having orifices to discharge liquid against articles in said racks; said orifices of said first and second spray arm devices additionally being directed to induce said devices into rotation in response to water flowing therethrough; means for mounting said first and second spray arm devices for rotation relative to said racks; a telescoping conduit attached in flow communication and rotatable with said first spray arm device, extensible upwardly to said second spray arm device; means for supplying washing liquid to said first spray arm device through said telescopic conduit and to said second spray arm device; and means attached to said second spray arm device for mechanically receiving said telescopic conduit for transmission of liquid to said second spray arm device while rotating; and telescopically extensible stabilizing means within said telescopic conduit to stabilize said conduit during transmission of washing water therethrough said means for mechanically receiving said telescopic conduit being a downwardly convex-shaped hub and the telescopic conduit including a conforming end portion for association therewith; and said stabilizing means including a base and a double-arched member attached by a telescoping rod assembly, said base being attached within a lower tube of said telescopic conduit and the double-arched member being attached to an upper tube of said telescopic conduit for stabilizing thereof.

2. The apparatus of claim 1, wherein the stabilizing means includes a biasing spring to return said conduit and said stabilizing means to its contracted position when no water is passing therethrough.

* * * * *